US007510444B2

(12) United States Patent
Chang et al.

(10) Patent No.: US 7,510,444 B2
(45) Date of Patent: Mar. 31, 2009

(54) SIM CARD CONNECTOR

(75) Inventors: Jui-Ming Chang, Tu-Cheng (TW); Yao-Ting Wang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/826,545

(22) Filed: Jul. 17, 2007

(65) Prior Publication Data

US 2009/0023343 A1 Jan. 22, 2009

(51) Int. Cl.
*H01R 24/00* (2006.01)

(52) U.S. Cl. ..... 439/630; 439/733.1; 439/862

(58) Field of Classification Search ..... 439/630, 439/563, 733.1, 570, 862
See application file for complete search history.

(56) References Cited

U.S. PATENT DOCUMENTS 6,302,711 B1 * 10/2001 Ito ..... 439/83
6,312,274 B1 * 11/2001 Lin ..... 439/188
6,994,566 B2 * 2/2006 You ..... 439/66
7,322,839 B1 * 1/2008 Wu et al. ..... 439/159
7,329,146 B2 * 2/2008 Yang et al. ..... 439/570
2005/0208834 A1 * 9/2005 Kodaira et al. ..... 439/630
2005/0239333 A1 * 10/2005 Watanabe et al. ..... 439/630
2007/0128942 A1 * 6/2007 Li ..... 439/630

* cited by examiner

*Primary Examiner*—Hien Vu
(74) *Attorney, Agent, or Firm*—Rosenberg, Klein & Lee

(57) ABSTRACT

A SIM card connector includes an insulating body and a plurality of electric terminals. The insulating body has accepting holes and accepting cavities. The electric terminal has a welded slice, a contact and a fixing portion. The welded slice and the contact are accepted in the accepting hole, the contact projects from the accepting hole. A lump is formed in one side of the fixing portion, the fixing portion accepted in the accepting cavities. While the SIM card connector passes through a SMT apparatus, the insulated body is soften and the lump is against the side wall of the accepting cavities for preventing the holding portion out of the insulated body. Therefore, the SIM card connector is welded firmly in the PCB of a mobile.

4 Claims, 4 Drawing Sheets

SIM CARD CONNECTOR

BACKGROUND OF THE INVENTION

1. Field of the Invention

This present invention relates to a SIM card connector, and more particularly to an electric terminal structure of a SIM card connector.

2. The Related Art

As the technology developing, mobility and portable devices have become an essential portion in daily life. In the conventional mobile system, the user must have a mobile apparatus and a SIM card according with the mobile apparatus to achieve the mobile function. The SIM card has lots of exposed points to electrically connect with a SIM card connector of a mobile, to achieve communicating, storing information, etc.

The SIM card connector is an important component for connecting a SIM card to the mobile. A conventional SIM card connector includes an insulated body and plenty of electric terminals assembled in the insulated body. The insulated body defines accepting holes and accepting cavities. The electric terminal has a conducted portion, a welded portion and a fixing portion, the conducted portion projects out of the insulated body for connecting with a SIM card. The fixing portion has two lumps formed at two sides of the fixing portion, and the lumps are accepted in the accepting cavities. In assembly, the lump of the fixing portion interferes with the inner wall of the accepting cavity, the welded portion is welded in a PCB of the mobile. In order to achieve steadiness and product efficiency, now the SMT technology is used for being welded usually, however the hot temperature at the SMT processing will soften the SIM card connector, because the insulated body of the SIM card is made of plastic usually. The movement direction and the assembly direction of the electric terminal are inverse, and the insulated body becomes soft, so the strength of the electric terminal against the accepting cavity will be released, and the welded portion of the terminal will be raised. Therefore the SIM card connector is not located firmly in a PCB by the electric terminals being welded to the PCB, the insulated body looses with the electric terminals, the SIM card is not accepted in the SIM card connector accurately, and then the information transmission between the SIM card and the mobile is not steady.

SUMMARY OF THE INVENTION

An object of the invention is to provide a SIM card connector solved the above-mentioned question, the SIM card connector comprises an insulated body and electric terminals. The insulated body has an upper surface and a lower surface, accepting holes defined in the lower surface, accepting cavities through the upper surface and connected with the accepting holes, two accepting grooves arranged in the side of the accepting hole. The electric terminals are accepted in the accepting holes and the accepting cavities. Each of the electric terminal has a first connected portion, one end of the first connected portion extends to form a welded slice, the other end of the first connected portion extends upward to form a bend portion, the free end of the bend portion extends to form a second connected portion approximately parallel with the first connected portion, a contact projects from the free end of the second connected portion. The first connected portion extends to form two fixing portions at two sides thereof. The fixing portion has an extendable spring which connects the fixing portion with the first connected portion. The front end of the extendable spring extends upward to form a resisting portion. A lump projects from one side of the resisting portion, the other side of the resisting portion has a gradient, the top of the resisting portion is narrower than the bottom of the resisting portion. A gap is formed below the lump.

As the above description, one side of the fixing portion of the electric terminal forms a lump and the other side of the fixing portion forms a gradient. When the electric terminal is assembled with the insulated body, the lump interferes with part of the inner wall of the accepting groove. When the SIM card connector passes through a SMT apparatus, the insulated body is softened, the lump is against another part of the inner wall of the accepting groove for preventing the holding portion departing from the insulated body, therefore the SIM card connector is welded firmly in the PCB of a mobile, the information is steadily transmitted between the SIM card and the PCB.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
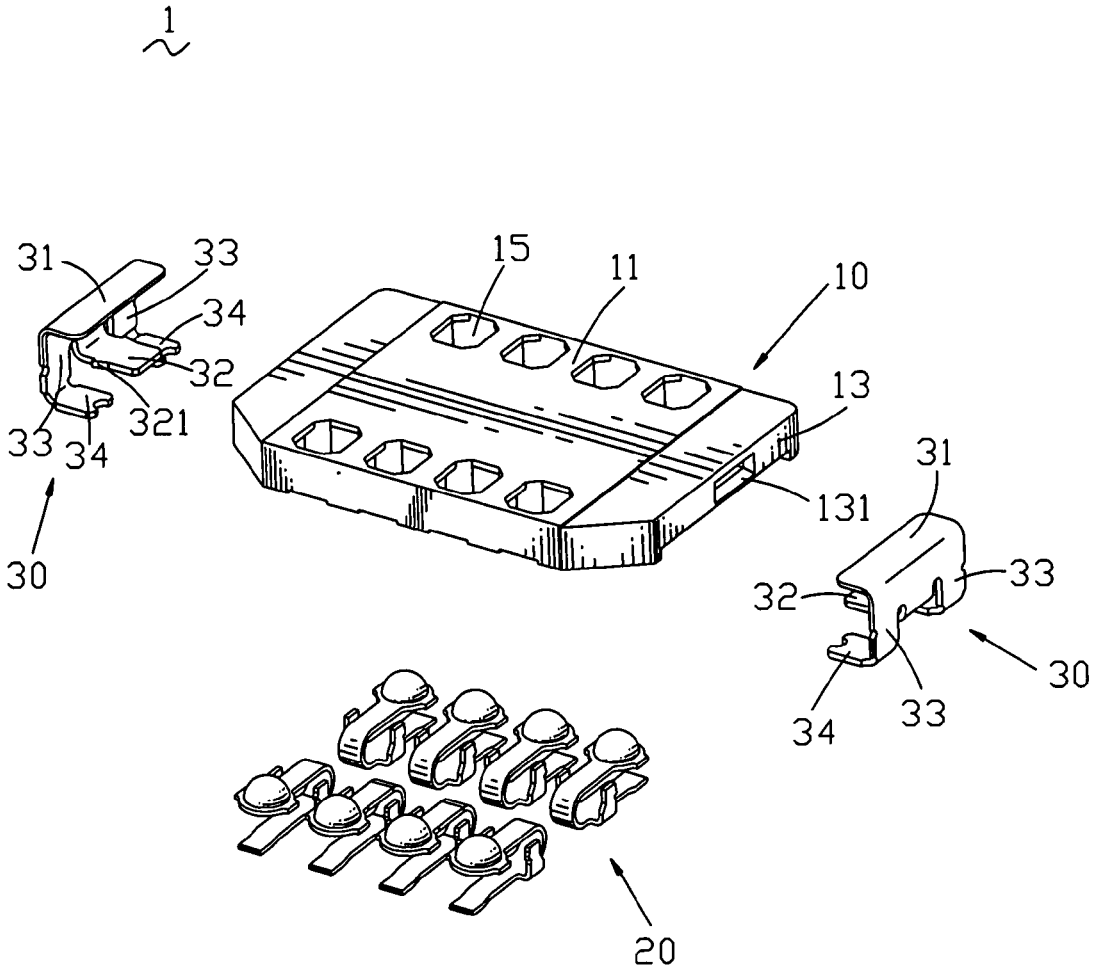
FIG. 1 is an exploded perspective view of a SIM card connector according to the present invention.

First referring to FIG. 1, a SIM card connector 1 according to the invention is shown. The SIM card connector 1 comprises an insulated body 10, plenty of electric terminals 20 and holding slices 30.

Figure 2:
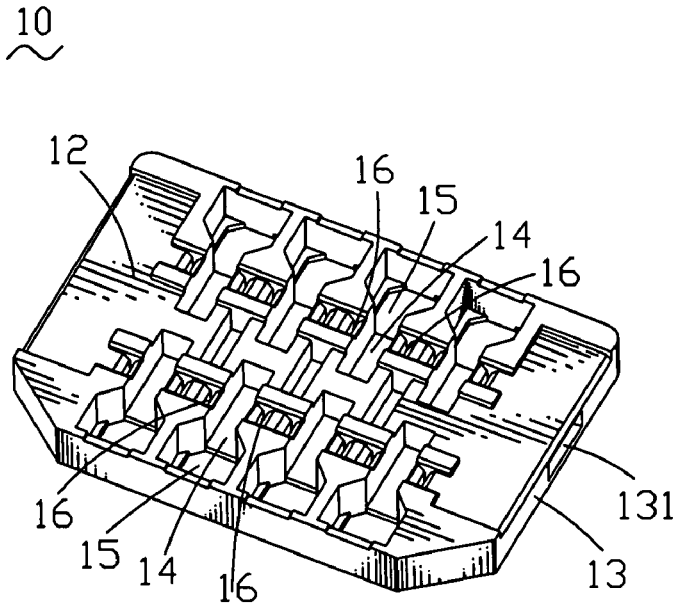
FIG. 2 is a perspective view showing an insulated body of the SIM card connector.
Figure 6:
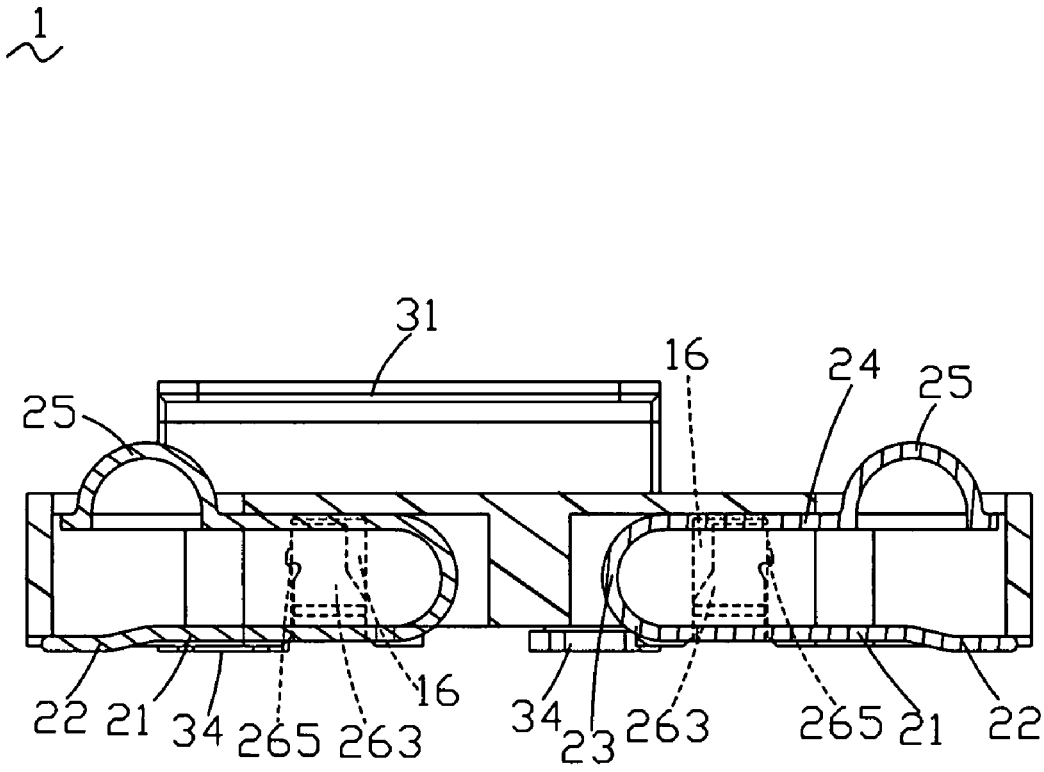
FIG. 6 is a cross-sectional view taken along line VI-VI of FIG. 4.

Referring to FIG. 1, FIG. 2 and FIG. 6, the insulated body 10 has an upper surface 11, a lower surface 12 and two side surfaces 13. A plurality of accepting holes 14 are defined at the lower surface 12, an accepting cavities 15 is defined in the upper surface 11 and connected with the accepting holes 14, the accepting cavity 15 is wider than the accepting hole 14. Two sides of the accepting hole 14 have an accepting groove 16 respectively. Two fastening grooves 131 are arranged in the side surfaces 13 symmetrically.

Figure 3:
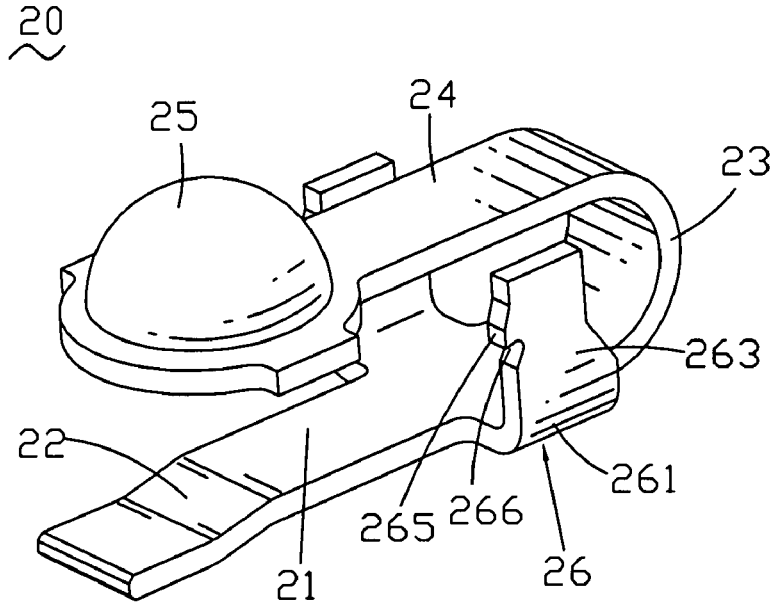
FIG. 3 is a perspective view showing an electric terminal of the SIM card connector.

Referring to FIG. 3, the electric terminal 20 has a first connected portion 21, one end of the first connected portion 21 extends to form a welded slice 22, the other end of the first connected portion 21 extends upward to form a bend portion 23, the free end of the bend portion 23 extends horizontally to form a second connected portion 24, the second connected portion 24 approximately parallels with the first connected portion 21. A contact 25 projects from the front of the second connected portion 24, and the contact 25 has a hemisphere shape and is above the welded slice 22.

In this present invention, two fixing portions 26 are formed at the two sides of the first connected portion 21 symmetrically. The fixing portion 26 has an extendable spring 261 which connects the fixing portion 26 to the first connected portion 21. The end of the extendable spring 261 extends upward to form a resisting portion 263. A lump 265 projects from one side of the resisting portion 263, a gap 266 is formed below the lump 265. The other side of the resisting portion 263 has a gradient, the top of the resisting portion 263 is narrower than the bottom of the resisting portion 263.

Please refer to FIG. 1 again, the holding slice 30 has a first holding portion 31. The first holding portion 31 extends downward and then inward to form a located slice 32, two sides of the located slice 32 forms two bards 321 symmetrically. The first holding portion 31 extends downward to form two connecting bodies 33 at two sides of the located slice 32 symmetrically, the bottom of the connecting body 33 extends inward to form a second holding portion 34 parallel with the first holding portion 31.

Figure 4:
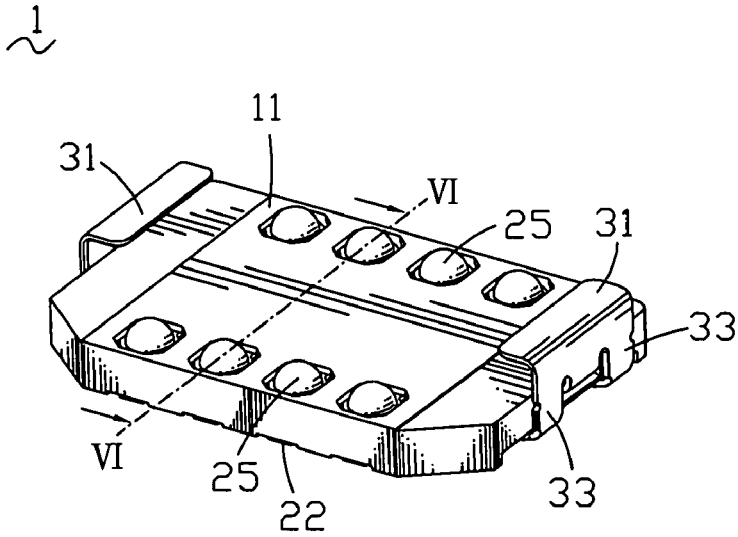
FIG. 4 is a perspective view showing the top of the SIM card connector.
Figure 5:
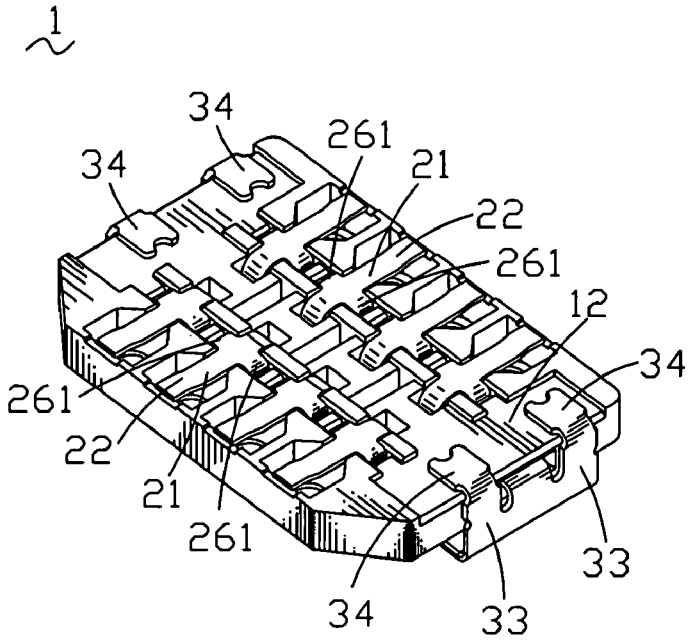
FIG. 5 is a perspective view showing the bottom of the SIM card connector.

Please refer to FIGS. 4-6, the first connected portion 21, the bend portion 23 and the second connected portion 24 are accepted in the accepting holes 14, the welded slice 22 is welded with a PCB (not shown), the contact 25 is accepted in the accepting cavities 15 of the insulated body 10, the top of the contact 25 projects out of the upper surface 11 of the insulated body 10 and for connecting with a SIM card (not shown). The fixing portion 26 is accepted in the accepting groove 16 of the insulated body 10. The lump 265 is against the inner wall of the accepting groove 16.

The located slice 32 is accepted in the fastening groove 131, the bard 321 is against the inner wall of the fastening groove 131, the second holding portion 34 covers on the lower surface 12, the connecting body 33 is against the side surface 13, the first holding portion 31 covers on the upper surface 11.

Just as description in the aforementioned preferred embodiment of the present inventing, one side of the fixing portion 26 of the electric terminal 20 forms a lump 265 and the other side of the fixing portion 26 forms a gradient. When the electric terminal 20 is assembled with the insulated body 10, the lump 265 interferes with part of the inner wall of the accepting groove 16. When the SIM card connector 1 passes through a SMT apparatus, the insulated body 10 is softened, the lump 265 is against another part of the inner wall of the accepting groove 16 for preventing the holding portion 26 departing from the insulated body 10, therefore the SIM card connector 1 is welded firmly in the PCB of a mobile, the information is steadily transmitted between the SIM card and the PCB.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A SIM card connector used to connect a SIM card with an electric apparatus, comprising:

an insulated body having an upper surface and a lower surface, accepting holes defined in the lower surface, accepting cavities formed through the upper surface and connected with the corresponding accepting holes, two accepting grooves respectively arranged along opposing sides of each of the accepting holes, each of the accepting grooves defining a first inner side surface and a second inner side surface opposite to the first inner side surface; and electric terminals, each disposed in one of the accepting holes and a corresponding one of the accepting cavities, each of the electric terminals having a first connected portion, one end of the first connected portion extending to form a welded slice, the other end of the first connected portion extending upward to form a bend portion, the free end of the bend portion extending to form a second connected portion approximately parallel with the first connected portion, a contact projecting from the free end of the second connected portion;

wherein the first connected portion of each of the electric terminals extending to form two fixing portions at two sides thereof, each fixing portion having an extendable spring which connects the fixing portions with the first connected portion, a free end of the extendable spring extending upward to form a resisting portion with a first lateral side and a second lateral side opposite the first lateral side, a protrusive member formed on the first lateral side of each resisting portion, the second lateral side of each resisting portion having a ramp formed thereon, a top portion of each resisting portion being narrower than a bottom portion of each resisting portion, wherein the protrusive member projecting from the first lateral side of each resisting portion engaging the first inner side surface of a corresponding accepting groove; a surface above the ramp of the second lateral side of each resisting portion is disposed in spaced relation apart from the second inner side surface of the corresponding accepting groove; and a surface below the ramp contacting the second inner side surface of the respective accepting groove.

2. The SIM card connector as set forth in claim 1, further comprising holding slices, each of the holding slices having a first holding portion, the first holding portion extending downward and then inward to form a located slice having two opposing sides, the first holding portion extending downward to form two connecting bodies, each of the connecting bodies arranged proximal to a respective opposing side at two sides of the located slice, the the free end portion of each connecting body extending inward to form a second holding portion parallel with and below the first holding portion, each side of the located slice forming a barb.

3. The SIM card connector as set forth in claim 2, wherein the insulated body has two opposing side surfaces, each of the side surfaces of the insulated body having a fastening groove formed there, the fastening groove defining an inner wall, the located slice of each holding slice is received in a respective fastening groove, each barb is abutted against an inner wall of a respective fastening groove, the second holding portion of each holding slice covers a lower surface of the insulated body, the connecting bodies of each holding slice are disposed against the side surface, the first holding portion of each of the holding slices covers an upper surface of the insulated body.

4. The SIM card connector as set forth in claim 1, further comprising a gap formed at the first side of each resisting portion, which is formed as a concave shape below the protrusive member.

* * * * *